US005188535A

United States Patent [19]

Bertho et al.

[11] Patent Number: 5,188,535

[45] Date of Patent: Feb. 23, 1993

[54] LOW PROFILE ELECTRICAL CONNECTOR

[75] Inventors: Dominique Bertho, Himiko Ct., Singapore; Jerry D. Kachlic, Milpitas, Calif.; Yap Y. Teck, Cashew Heights, Singapore

[73] Assignee: Molex Incorporated, Lisle, Ill.

[21] Appl. No.: 882,782

[22] Filed: May 14, 1992

Related U.S. Application Data

[63] Continuation-in-part of Ser. No. 793,771, Nov. 18, 1991, Pat. No. 5,145,386.

[51] Int. Cl.[5] ..... H01R 9/09

[52] U.S. Cl. ..... 439/83; 439/82; 439/682

[58] Field of Search ..... 439/76, 78, 81–83, 439/682

[56] References Cited

U.S. PATENT DOCUMENTS

| | | | |
|---|---|---|---|
| 4,303,297 | 12/1981 | Smart et al. | 339/218 M |
| 4,341,429 | 7/1982 | Bright et al. | 339/74 R |
| 4,418,971 | 12/1983 | Liss | 339/17 L |
| 4,487,464 | 12/1984 | Kirschenbaum | 339/19 |
| 4,580,857 | 4/1986 | Stepan | 339/17 LC |
| 4,597,625 | 7/1986 | Seidler | 339/176 M |
| 4,767,342 | 8/1988 | Sato | 439/78 |
| 4,880,399 | 11/1989 | Ichimura et al. | 439/689 |
| 4,917,614 | 4/1990 | Kikuchi et al. | 439/83 |
| 4,979,903 | 12/1990 | Gosselin | 439/78 |
| 5,145,386 | 9/1992 | Berg et al. | 439/83 |

FOREIGN PATENT DOCUMENTS 0081937 4/1986 European Pat. Off. .

*Primary Examiner*—Paula A. Bradley
*Attorney, Agent, or Firm*—Charles S. Cohen

[57] ABSTRACT

An electrical connector includes a dielectric housing having a terminal-receiving passage defining a terminal-insertion axis for receiving a mating terminal member. A stamped and formed sheet metal contact member has a contact end disposed in the passage and a terminal end projecting from the housing. The housing has top and bottom walls, with the terminal-receiving passage extending in a direction therebetween. A slot is provided in a side wall of the housing communicating with the passage. The contact end of the contact member is inserted into the slot and is generally planar and has a terminal-receiving slot. The plane of the contact end and the slot are disposed generally transverse to the terminal-insertion axis. The contact member includes an intermediate portion located adjacent the contact end to provide additional flexiblity to the contact arms at the contact end.

19 Claims, 4 Drawing Sheets

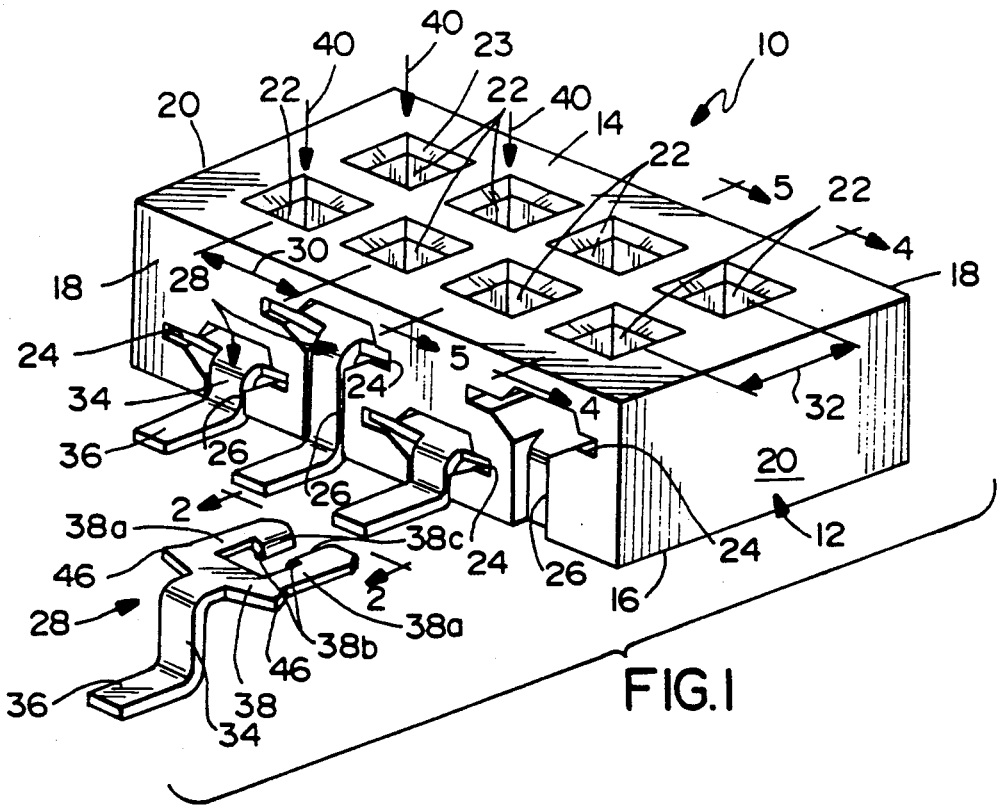
FIG.1
FIG.2
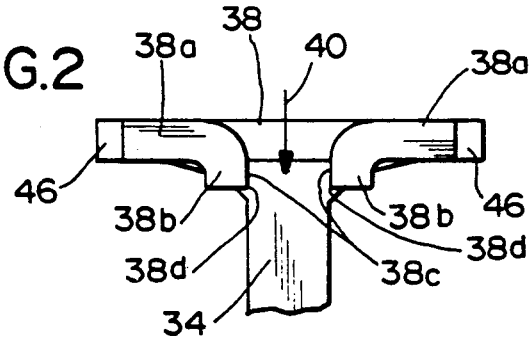
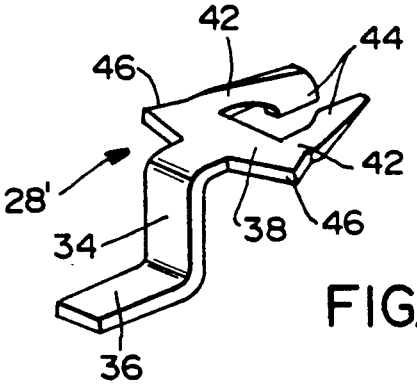
FIG.3
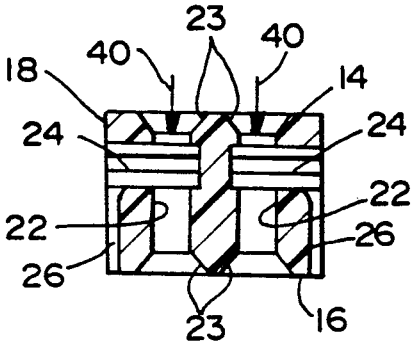
FIG.4
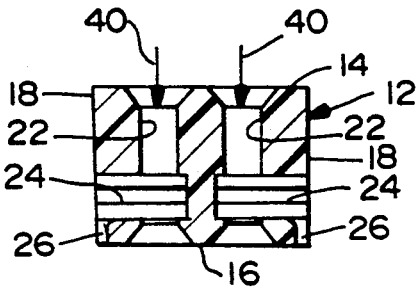
FIG.5

LOW PROFILE ELECTRICAL CONNECTOR

RELATED APPLICATION

This application is a continuation-in-part of application Ser. No. 07/793,771, Nov. 18, 1991, now U.S. Pat. No. 5,145,386.

FIELD OF THE INVENTION

This invention generally relates to the art of electrical connectors and, particularly, to an electrical connector having a low profile afforded by unique contact constructions and mounting arrangements of the contacts in the connector.

BACKGROUND OF THE INVENTION

There are a wide variety of electrical connector constructions which conventionally include a dielectric housing which mounts a plurality of contact members, with the housing having a plurality of passages for receiving mating terminals in engagement with contact portions of the contact members. A common type of contact member is a stamped and formed sheet metal member which includes a portion or end configured for engaging a respective terminal inserted into one of the passages in the dielectric housing.

One of the problems with electrical connector constructions of the character described above centers around the ever-increasing miniaturization of various electronic equipment. The electrical connectors used in such equipment, likewise, are increasingly miniaturized, yet the advantages of stamped and formed contact members still must be realized.

An example of such miniaturization is in the area of computer disk drives. Extremely low profile electrical connectors are being required, including versatile connectors which are capable of receiving a mating terminal in either of two opposite directions and with appreciable contacting forces. The contact pitch (spacing) in such electrical connectors also is becoming continuously smaller which also creates problems in the overall design of the connectors.

This invention is directed to solving the above problems by providing a very low profile connector having a very small pitch.

SUMMARY OF THE INVENTION

An object, therefore, of the invention is to provide a new and improved low profile electrical connector construction, particularly including novel contact and housing configurations.

Generally, the invention is directed to an electrical connector which includes a dielectric housing having an elongated direction generally perpendicular to a low profile direction. The housing has terminal-receiving passages defining terminal-insertion axes for receiving mating terminal members in the low profile direction. The low profile configuration of the housing results in short side walls thereof. A plurality of stamped and formed sheet metal contact members are mounted on the housing. The contact members have contact ends disposed in the terminal receiving passages and terminal ends projecting from the housing. The contact ends of the contact members are inserted through slots in the side walls of the connector housing.

The invention contemplates that the contact ends of the contact members be mounted through the slots in the short side walls of the housing, with the contact ends spanning the terminal receiving passages. The contact ends are generally planar and have terminal-receiving slots with the planes of the contact ends being disposed generally transverse to the terminal insertion axes of the passages.

As disclosed herein, each contact end of each contact member is bifurcated to define a pair of arms having inwardly projecting distal ends defining the terminal receiving slot thereof. The inwardly projecting ends are bent or twisted out of the plane of the contact end to define surface means for engaging the mating terminal member when inserted into the respective terminal receiving passage in either direction. Another feature is to lengthen the arms to provide additional flexibility which results in reduced insertion forces.

The invention also contemplates that in one configuration the planar contact ends of the contact members are wider than the pitch of the mating terminal members to provide increased stability for the contact ends of the contact members. Accordingly, the contact ends for a given row of terminal receiving passages are staggered in a direction generally parallel to the terminal insertion axes of the passages.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

FIG. 1 is a perspective view of an embodiment of an electrical connector incorporating the concepts of the invention, with one of the contact members removed from the housing to facilitate the illustration;

FIG. 2 is a fragmented elevational view of one of the contact members looking generally in the direction of line 2—2 of FIG. 1;

FIG. 3 is a perspective view of an alternate form of contact member in comparison with the contact member shown in FIGS. 1 and 2;

FIG. 4 is a vertical section through the housing of the connector taken generally along line 4—4 of FIG. 1, with the terminals removed;

FIG. 5 is a vertical section through the housing similar to that of FIG. 4 taken generally along line 5—5 of FIG. 1, with the terminals removed;

Figure 10:
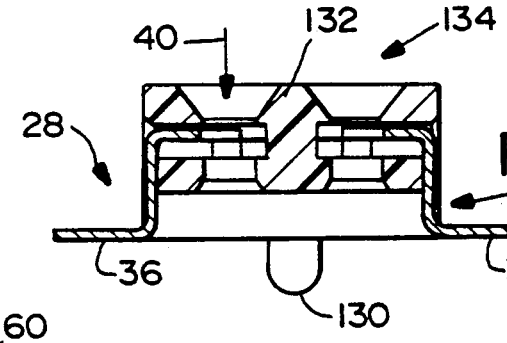
Figure 7A:
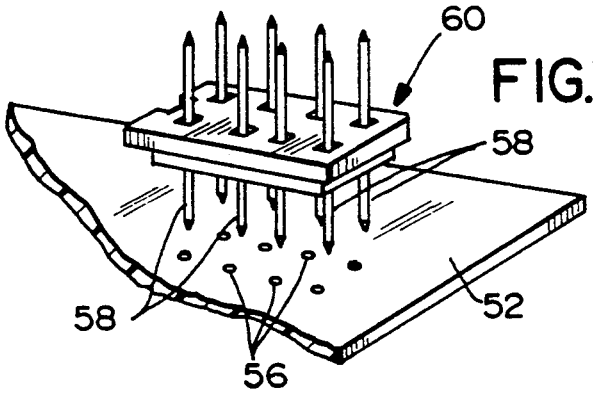
FIG. 7 is a perspective view of the electrical connector of FIG. 1 mounted to the bottom of a printed circuit board.
Figure 7:
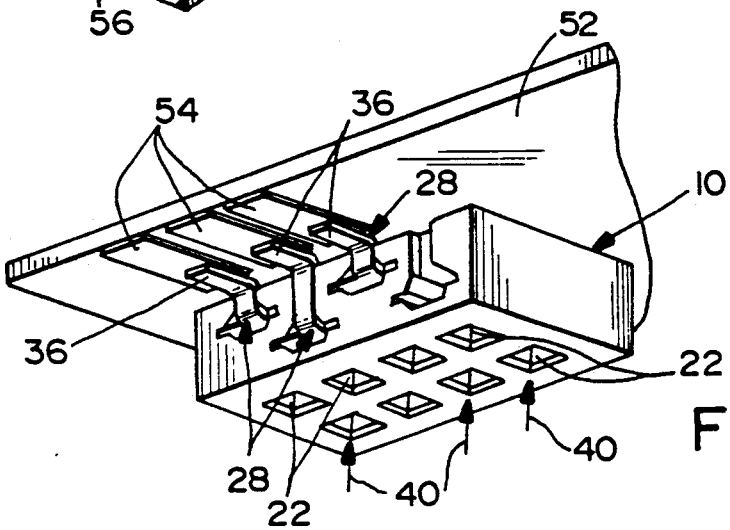
Figure 9:
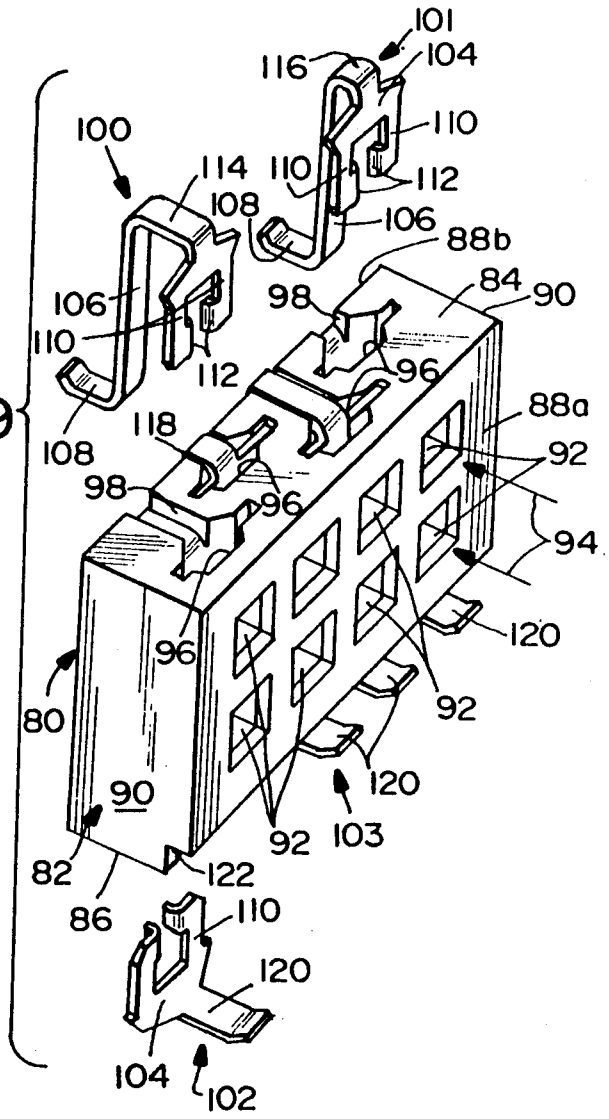
Figure 8:
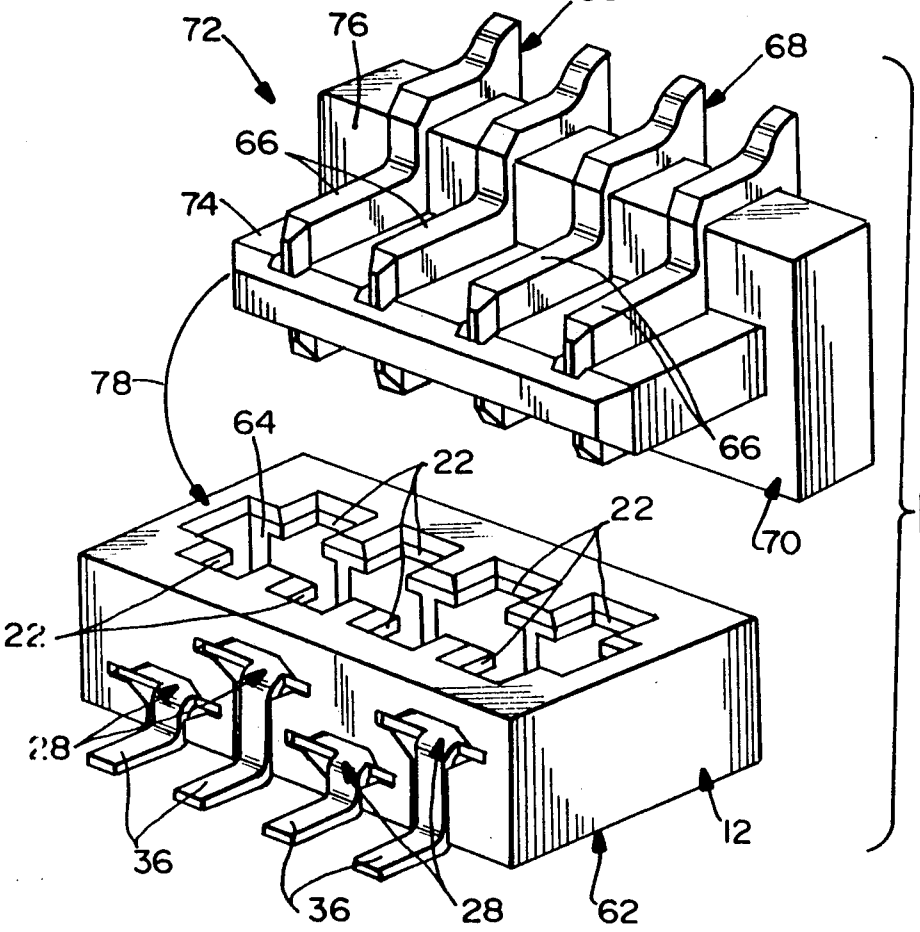
Figure 11:
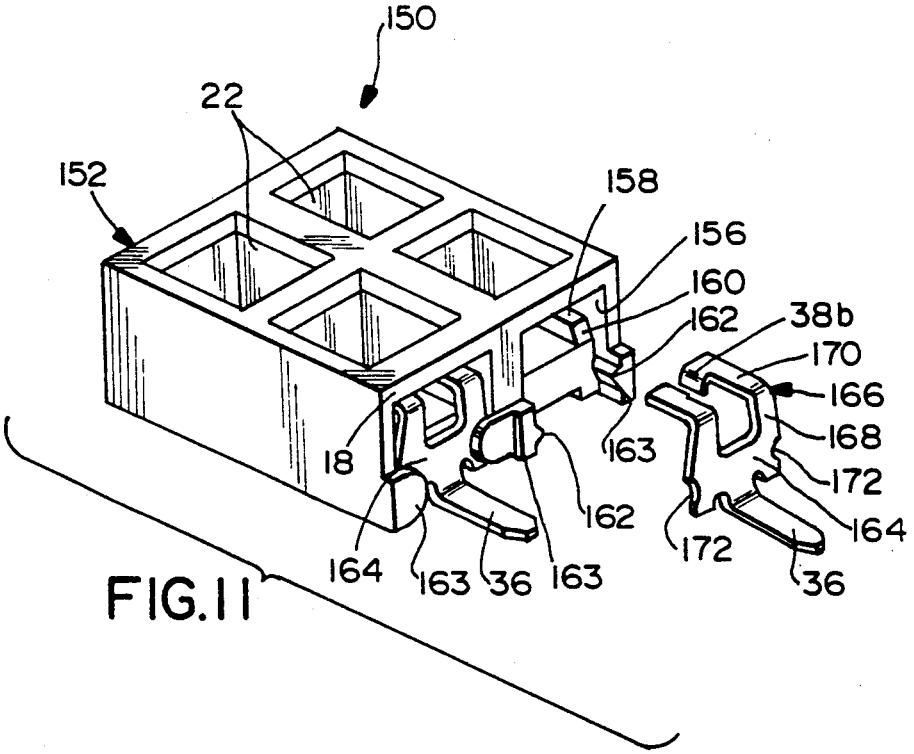
Figure 12:
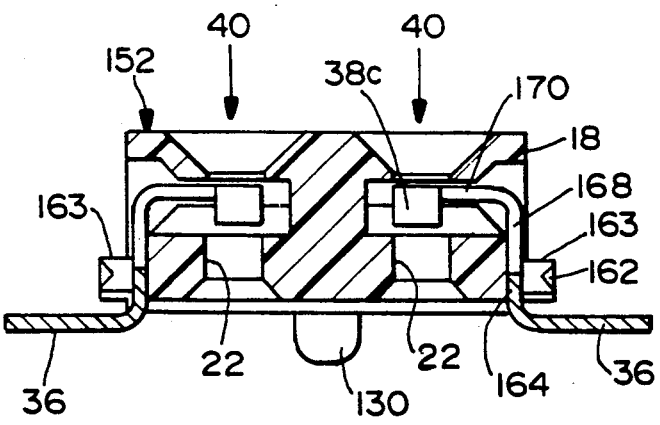
Figure 13:
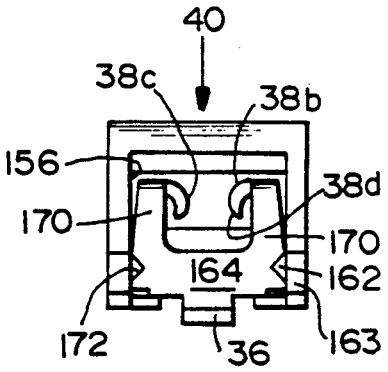

FIG. *7a* is a perspective view of the printed circuit board of FIG. 7 in which a mating header component is about to be inserted into the top of the board;

FIG. 8 is an exploded perspective view of a modified form of the electrical connector of FIG. 1 for receiving a different type of mating connector component as shown;

FIG. 9 is perspective view of another embodiment of an electrical connector embodying the concepts of the invention, with three of the contact members removed from the connector housing to facilitate the illustration;

FIG. 10 is a vertical section similar to FIG. 5 of still another embodiment of the present invention;

FIG. 11 is a fragmented perspective view of still another embodiment of the present invention, with one of the terminals removed from the housing to facilitate the illustration;

FIG. 12 is a vertical section similar to that of FIG. 10 but of the embodiment shown in FIG. 11; and FIG. 13 is an elevational view of one of the contact members looking generally in the direction of line 13—13 of FIG. 12.

DETAILED DESCRIPTION OF THE PREFERRED EMBODIMENTS

Referring to the drawings in greater detail and first to FIG. 1, the invention is depicted in an electrical connector construction or assembly, generally designated 10, which includes a unitary dielectric housing, generally designated 12, molded of plastic material or the like. The housing is elongated as defined by a top wall 14, a bottom wall 16 and a pair of side walls 18, all terminating in end walls 20. The housing has a plurality of through passages 22 extending between top and bottom walls 14 and 16, respectively. Each through passage 22 has a tapered lead-in 23 at each end of the passage. As will be better understood below, after a description of the contact members, the housing also has slots 24 and grooves 26 in both opposite side walls 18 for receiving and positioning contact members, generally designated 28, that engage mating contact members, such as appropriate terminal pins, inserted into through passages 22.

Referring to the array of through passages 22 which are visible in top wall 14 of housing 12 in FIG. 1, an electrical connector constructed as shown has two rows of four passages, as illustrated, with the pitch (spacing) between the passages in each row, as indicated by double-headed arrow 30, and the pitch (spacing) between the passages in the respective rows, as indicated by double-headed arrow 32, on the order of 1.0 mm.

Still referring to FIG. 1, each contact member 28 is a stamped and formed sheet metal component which includes an elongated body portion 34, with a tail end 36 and a pin receiving end 38 projecting perpendicularly away from, but on opposite sides of body portion 34 at opposite ends thereof. Pin receiving end 38 of each contact member 28 is bifurcated by means of a pair of arms 38*a* having projecting ends or tabs 38*b* that project toward the end 36 upon which the tail is located.

Referring to FIG. 2 in conjunction with FIG., 1, the configuration of projecting tabs or ends 38*b* of arms 38*a* of pin receiving end 38 of each contact member 28 are more clearly depicted. It can be seen that the tabs are bent downwardly in the direction of body portion 34 of the contact member so that opposing surfaces 38*c* are presented parallel to the insertion direction of a mating member, as indicated by arrow 40. This insertion direction 40 of a mating member or pin also is illustrated in FIG. 1 and can be considered the insertion axis for each through passage 22. It can be clearly seen in FIG. 2 that a mating pin can easily be inserted into pin receiving end 38 from the direction opposite elongated body portion 34. Further, by shaping projecting tabs 38*b* so that they project sufficiently towards portion 34 and creating rounded edges 38*d* at the lower edge of surfaces 38*c*, pin receiving end 38 can also mate with a pin inserted along the elongated body portion 34 without "stubbing." As a result, electrical connector 10 can be used either as a "top" or "bottom" loading connector with mating members being inserted from either end of the respective passages.

FIG. 3 shows an alternate form of a contact member, generally designated 28', which, as with contact member 28, includes an elongated body portion 34, a tail end 36 and a pin receiving end 38, but with arms 42 of contact end 38 being twisted to present opposing surfaces 44 within a respective contact-receiving passage 22. The twisting of arms 42 is for the same purposes as bending tabs 38*b* of contact member 28 in FIGS. 1 and 2 (i.e., to allow both top and bottom entry into electrical connector 10 without stubbing or scoring the mating terminal members). If desired, a combination of bending tabs 38*b* and twisting arms 42 could be utilized.

Referring to FIGS. 4 and 5 in conjunction with FIG. 1, the invention contemplates a staggering of slots 24 (and accompanying grooves 26) for contact members 28 in opposite side walls 18 of connector housing 12, in order to permit contact members 28 to be of sufficient size yet still permit the close pitch of contact-receiving passages 22, as described above in relation to spacings 30 and 32.

More particularly, it can be seen by slots 24 (and grooves 26) in the near side wall 18 in FIG. 1, that the slots are arranged in upper and lower levels, in an alternating or staggered array. FIG. 4 shows the location of the upper level of slots, and FIG. 5 shows the location of the lower level of slots. In the embodiment shown, there are four contact-receiving passages 22 in each of the two rows thereof as seen in FIG. 1. Accordingly, there are two slots in the upper level and two slots in the lower level for each row of passages on each side of the housing.

By providing the two levels of slots in a staggered array, bifurcated pin receiving ends 38 of contact members 28 can be made wider than if the slots and contact ends were in a single row and the contact members were on the same 1.0 mm pitch. The use of wider pin receiving ends allows the contact members to be larger and thus easier to manufacture. In addition, larger contact members provide greater strength and a greater ability to predetermine the contact engaging forces against the mating pin members.

Pin receiving ends 38 of the contact member, including arms 38*a* thereof, define a generally planar portion of the contact member, with the arms and downwardly bent tabs 38*b* defining a pin receiving opening which is disposed generally perpendicular to the terminal-insertion axes 40 depicted in FIGS. 1, 2, 4 and 5.

Arms 38*a* (42 in FIG. 3) of the contact ends 38 of the contact members include outwardly projecting barbs 46 for digging into the plastic material of housing 20 along the side edges of slots 24 to securely fix the contact members within the slots of the housing. By inserting contact members 28 into the housing 12 through slots 24 which are perpendicular to through passages 22 and the axis of mating, there is little, if any, force attempting to back out the contact members during mating. That is, the barbs 46 and the plastic housing 12 do not have to directly oppose the insertion and withdrawal actions.

Grooves 26 in the opposite side walls 18 of housing 12 communicate with slots 24 to accommodate body portions 34 of contact members 28, whereby the outer surfaces of the body portions are generally flush with the outside surfaces of side walls 18. This permits the connector 10 to require less space on a printed circuit board. As seen in FIG. 1, tail ends 36 of the contact members (on both sides of the connector) are generally coplanar for surface mounting the connector, as illustrated below. Consequently, the body portions of the contact members which are inserted into the upper level of slots are longer than the body portions of the contact members which are inserted into the lower level of slots. If desired, the tail ends could be inserted through holes in a printed circuit board rather than surface mounted.

Figure 6:
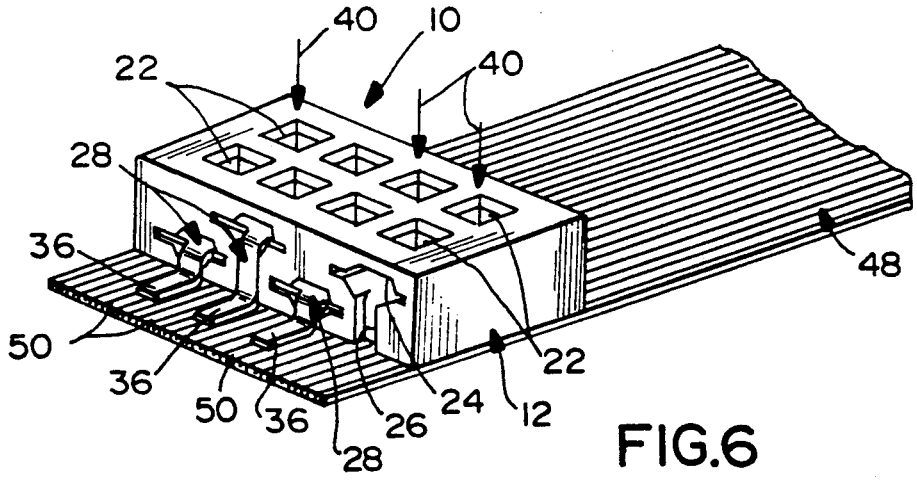
FIG. 6 is a perspective view showing the electrical connector of FIG. 1 surface mounted to a flat flexible cable.

FIGS. 6 and 7 show some of the uses of electrical connector 10 described above in relation to FIGS. 1–5. Referring to FIG. 6, the electrical connector is shown surface mounted to the top of flat flexible cable, generally designated 48, which includes a plurality of conductive strips 50 running along the length of the cable. Connector 10 is positioned on top of the flat flexible cable and tail ends 36 of contact members 28 are conductively affixed to the terminal strips, as by soldering through known surface mount procedures. The connector then is ready for receiving mating terminal members, such as terminal pins, inserted into terminal-receiving passages 24 as indicated by arrows 40. Electrical connector 10 thereby is effective to electrically couple the mating terminal members or pins to conductive strips 50 of flat flexible cable 48. Of course, absent holes in the flat flexible cable, the connector depicted in FIG. 6 could only be mated from one direction.

FIG. 7 shows a printed circuit board 52 having circuit traces 54 on the bottom surface. Again, electrical connector 10 is surface mounted to the printed circuit board, with tail ends 36 of contact members 28 electrically connected to circuit traces 54, as by soldering. The connector then is ready to receive appropriate mating terminal members inserted into terminal receiving passages 22 either from above or below the printed circuit board to electrically couple the pins to circuit traces 54 on the printed circuit board.

FIG. 7*a* shows the top of printed circuit board 52, with holes 56 in the printed circuit board aligned with passages 22 and axes 40 and through which terminal pins 58 of a mating header component, generally designated 60, are insertable.

FIG. 8 shows a modified form of electrical connector 10 and is generally designated 62. Like numerals have been applied to FIG. 8 corresponding to like components described in relation to electrical connector 10 in FIG. 1. Dielectric housing 12 has been modified to include an enlarged slot or opening 64 running through the center of the housing, with terminal-receiving passages 22 opening into slot 64. The terminal receiving ends 38 of contact members 28 still project perpendicularly into and across the individual terminal-receiving passages 22. The modified construction of housing 12 in connector 62 is designed for receiving legs 66 of a plurality of mating terminal members 68 mounted to the sides of a T-shaped insert housing 70 of a mating connector component, generally designated 72. Housing 70 includes a depending leg or flange 74 which is inserted into enlarged slot 64 of electrical connector 62. The cross or upper flange portion 76 of T-shaped housing 70 will lie above top wall 14 of housing 12 of connector 62 and could act as a stop. Connector component 72 is mated with electrical connector 62 by inserting flange 74 into slot 64 and legs 66 into terminal receiving passages 22, as indicated by arrow 78. Surface mount tails 36 are utilized to secure component 72 to a printed circuit board or flat flexible cable or other electrical component by surface mounting.

From the foregoing description of electrical connectors 10 and 62 in relation to FIGS. 1–8, it can be seen that the connectors have a very low profile (i.e., a very short height in the direction of insertion of the mating terminal members). In other words, terminal-receiving passages 22 are rather short. This low profile is afforded by orienting generally planar pin receiving ends 38 of contact members 28, 28' in planes spanning the terminal-receiving passages 22, i.e., generally perpendicular to the terminal-insertion axes 40. In addition, the pin receiving ends of the contact members are inserted into dielectric housing through the short side walls thereof. Still further, the staggered orientation of the contact ends of the contact members at different levels allows a small pitch between the mating terminal members while still providing a relatively large pin receiving end when compared to the pitch.

FIG. 9 shows an electrical connector, generally designated 80, which employs the general principles embodied in electrical connector 10, but the "low profile" of the connector is utilized to provide a thin dimension in relation to horizontal and thus minimizes the amount of board space utilized. In particular, electrical connector 80 includes a dielectric housing, generally designated 82, having a top wall 84, a bottom wall 86, opposite side walls 88*a* and 88*b*, and end walls 90. Again, terminal-receiving passages 92 are provided for receiving appropriate mating terminal members or pins inserted into the housing along terminal-insertion axes 94. Top and bottom walls 84 and 86 have staggered slots 96 and grooves 98 for receiving contact members. The upper contact members are generally designated 100 and 101 and the lower contact members generally designated 102 and 103. As with the other embodiments, contact ends 104 of contact members 100–103 can be wider than the pitch or spacing between the passages 92, as represented by the spacing between insertion axes 94.

As with contact members 28 and 28' (FIGS. 1 and 3), contact members 100, 101 include elongated body portions 106 terminating in coplanar tail ends 108 for surface interconnection to electrical contacts on flat flexible cable, printed circuit boards and the like. Pin receiving ends 104, which are insertable into slots 96 in top wall 84 of housing 82, are bifurcated to define a pair of arms 110 having inwardly projecting distal ends or tabs 112 bent to present surfaces for engaging the mating pin members as described in relation to FIG. 2.

However, contact member 100 has a long leg portion 114 and contact member 101 has a short leg portion 116, both projecting generally perpendicularly from the respective body portion 106 at the end thereof opposite tail end 108. As seen in FIG. 9, contact ends 104 are bent to project generally perpendicularly from leg portions 114, 116 back toward tail ends 108. With the construction of contact members 100, 101 described above, contact ends 104 can be inserted into staggered slots 96 with leg portions 114, 116 received in the respective grooves 98, with body portions 106 extending downwardly along side wall 88*b* of housing 82, as at 118, and with tail ends 108 projecting outwardly from the housing at the bottom thereof for surface interconnection to appropriate terminal strips, circuit traces or the like of an appropriate electrical component such as a flat flexible cable or a printed circuit board.

Contact members 102, 103 are insertable into similar slots 96 and grooves 98 in bottom wall 86 of housing 82; the slots and grooves being a mirror image of the slots and grooves in top wall 84. The contact members 102, 103 are configured similar to contact members 100, 101 with body portions 106 and tail ends 108 of contact members 100, 101 completely removed, and with distal ends of leg portions 114 and 116 extended and shaped to define surface mounting tabs 120 (FIG. 9). These tabs along with tail ends 108 of contact members 100, 101 can be surface interconnected to appropriate contacts, terminal strips or circuit traces, as by soldering or the like. In this configuration, the connector 82 can only mate with pins that are inserted from one direction due to body portions 106 which extend along side 88*b*. Contact member 103 is identical to contact member 102 except that surface mounting tab 120 is longer so that tabs 120 are aligned. Although this is not necessary, it is desirable so that the solder joints can be easily inspected.

FIG. 9 also shows a feature wherein side wall 88*a* of housing 82 is molded with a relieved area or "notch" along the bottom edge of the side wall, as at 122, to allow for visual inspection of the quality of the solder joints, for instance, of terminal tabs 120.

It is contemplated that the connector of FIG. 1 could be modified to eliminate the upper rows of contact member 28 and substantially reduce the height of the connector. As such, pin receiving end 38 of contact members 28 would lie in one plane rather than two. Likewise, elongated body portion 34 would be of one length rather than two. FIG. 10 shows a section through such alternative embodiment. The reduced height is especially apparent when FIG. 10 is compared to FIG. 5. Projections 130 may be provided extending from housing 132 to assist in locating connector 134 on a printed circuit board (not shown).

Still another alternative embodiment is shown in FIGS. 11–13 and is generally designated 150. Like numerals have ben applied to FIGS. 11–13 corresponding to like components described in relation to electrical connector 10 in FIG. 1 and electrical connector 134 in FIG. 10. Connector 150 includes a unitary dielectric housing, generally designated 152, molded of plastic material or the like. The housing 152 is similar to housing 12 of connector 10 except that the portions of the housing that receive and contact terminals 154 are modified for the new terminal. Specifically, housing 152 includes female terminal receiving cavities 156 that project inwardly from sidewalls 18 of the housing. A pair of guide ribs 158 extend upwardly from the bottom surface of the cavity 156 and include ramp-like lead in sections 160 that are used to guide the terminal 154 into the cavity during assembly of the connector. In addition, the housing includes ribs 162 that project from posts 163 locating the terminals 166 in the housing 152 as described below. After the terminals 154 have been inserted into the housing cavity 156, posts 163 are deformed by heat staking to retain the terminal in place. The left most terminal visible in FIG. 11 and its associated ribs 162 and portion of post 163 are shown as being heat staked in place. In practice, the heat staking of more than one terminal would occur simultaneously. If desired, the terminals are held in place solely by an interference fit between the terminal 154 and ribs 162 without heat staking.

Each contact member 154 is a stamped and formed sheet metal component which includes a tail end 36, a base 164 projecting perpendicularly away from tail 36 and a pair of arms 166 that extend from base 164. Arms 166 include a first portion 168 that is generally coplanar with base 164 and a second portion 170 that is integrally formed with first portion 168 but generally perpendicular thereto. Arms 166 include downwardly projecting tabs 38*b* for contacting a mating pin. Through such a configuration, opposing surfaces 38*c* are presented generally parallel to the insertion direction of a mating male terminal, as indicated by arrow 40. By shaping projecting tabs 38*b* so that they project sufficiently downward and creating rounded edges 38*d* at the lower edge of surfaces 38*c*, the projecting tabs 38*b* can mate with a pin inserted along the mating axis without "stubbing" whether the pin is inserted from either end of a male pin receiving passage 22. Upon mating of terminal 154 with a mating male pin, second portions 170 of arms 166 will deflect outwardly away from the pin. In doing so, first portion 168 of arm 170 will tend to twist relative to base 164 rather than first portions 168 deflecting away from each other. Tail portion 36 is configured for surface mounting as is known in the art, but could also be configured for through-hole mounting. Recesses 172 are provided in the side edges of base 164 for locating terminal 154 in cavity 156 prior to heat staking the terminals in their final location. It should be understood that the embodiment shown in FIGS. 11–13 could be utilized with the dual row versions shown in FIGS. 1–9. In addition, second portion 170 could be modified by twisting those portions in a manner such as that shown in FIG. 3 and indicated by reference numeral 42. Through such twisting, the likelihood of stubbing is reduced even further.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector which includes a dielectric housing having a plurality of terminal-receiving passages, each defining a terminal-insertion axis for receiving a mating male terminal member, and a plurality of stamped and formed sheet metal female contact members, each having a contact end disposed in the passage and a tail portion for securing to a circuit element, the improvement comprising:

said housing having top and bottom walls, with the terminal-receiving passages extending in a direction therebetween, and with a cavity in a side wall of the housing communicating with each passage; and said contact end of each contact member being inserted into one of the cavities and being generally planar and having a terminal-receiving slot, with the plane of the contact end being disposed generally transverse to its respective terminal-insertion axis, each said contact member further including an intermediate portion between said contact end and said tail portion, said intermediate portion includes a pair of first spaced apart arms disposed at an angle to the contact end.

2. The electrical connector as set forth in claim 1, wherein the terminal-insertion axes are spaced at a given pitch, and said plurality of said stamped and formed sheet metal contact members are located to have their respective contact ends disposed in the terminal-receiving passages of the housing in a staggered array of at least two different levels, the width of the contact ends generally perpendicular to the terminal-insertion axes being wider than said pitch.

3. The electrical connector as set forth in claim 1, wherein said contact end of each contact member includes a pair of second spaced apart arms, each of said second spaced apart arms being integrally formed with one of said first spaced apart arms, and said second spaced apart arms have inwardly projecting distal ends defining said terminal-receiving slot, the inwardly projecting ends being bent out of the plane of the contact end to define surface means generally parallel to said axis for engaging the mating terminal member.

4. The electrical connector as set forth in claim 3, wherein said intermediate portion extends generally perpendicular to the contact end.

5. The electrical connector as set forth in claim further including means for locating and securing the contact members in the housing.

6. The electrical connector of claim 5 wherein said locating and securing means includes projections on said housing and recesses in said contact members.

7. The electrical connector as set forth in claim 1, wherein the tail portion of each contact member projects generally transversely from the intermediate portion thereof.

8. The electrical connector as set forth in claim 7, wherein said contact end of each contact member includes a pair of second spaced apart arms, each of said second spaced apart arms being integrally formed with one of said first spaced apart arms, and said second spaced apart arms have inwardly projecting distal ends defining said terminal-receiving slot, the inwardly projecting ends being bent out of the plane of the contact end to define surface means generally parallel to said axis for engaging the mating terminal member.

9. A low profile electrical connector comprising:

a dielectric housing, said dielectric housing having first and second walls, said first wall being generally perpendicular to said second wall, said first wall including a plurality of male terminal receiving openings therein into which male terminals may be inserted, said second wall including a plurality of spaced apart cavities projecting therethrough and communicating with said terminal receiving openings, each for receiving a portion of a female terminal therein; and a plurality of stamped and formed female terminals, each being associated with one of said cavities and each having a contact portion for receiving a male terminal, a tail portion for securing said contact to a circuit element, and an intermediate portion located therebetween, said contact portion including a pair of first spaced apart arms located within said terminal receiving opening, and said intermediate portion including a pair of second spaced apart arms, each of said first spaced apart arms being integrally formed with one of said second spaced apart arms.

10. The electrical connector of claim 9 wherein said first arms are positioned at an angle to said second arms.

11. The electrical connector of claim 10 wherein said angle is approximately 90 degrees.

12. The electrical connector of claim 11 wherein said female terminals further include a base portion between said intermediate portion and said tail portion and said female terminals are configured so that said second arms of said intermediate portion twist relative to said base portion.

13. The electrical connector of claim 12 wherein each of said first arms include an end portion extending inwardly toward the opposite first arm, the inwardly extending ends being bent out of the plane of the first arms to define surface means generally parallel to the axis of a mating male terminal for engaging a mating male terminal.

14. The electrical connector of claim 13 wherein said female terminals and housing are configured so that said mating male terminal can enter said terminal receiving opening through either said first wall or a third wall of said housing oriented parallel to said first wall to mate with said male terminal.

15. The electrical connector of claim 10 wherein said female terminals further include a base portion between said intermediate portion and said tail portion and said female terminals are configured so that said second arms of said intermediate portion twist relative to said base portion.

16. The electrical connector of claim 15 wherein each of said first arms include an end portion extending inwardly toward the opposite first arm, the inwardly extending ends being bent out of the plane of the first arms to define surface means generally parallel to the axis of a mating male terminal for engaging a mating male terminal.

17. The electrical connector of claim 16 wherein said female terminals and housing are configured so that said mating male terminal can enter said terminal receiving opening through either said first wall or a third wall of said housing oriented parallel to said first wall to mate with said male terminal.

18. An electrical connector assembly including a housing having first and second opposed surfaces and a plurality of male terminal receiving passages extending in a direction therebetween, and a plurality of female conductive contact members, each having a contact portion, a mounting portion and securing means to secure said female contact member to said housing, each said female contact member being oriented so that said contact portion thereof is positioned within one of said passages for receiving a mating male conductive member along an axis through said passage and the mounting portion of each said female contact member being positioned for electrically and mechanically securing said female contact member to an electrically conductive component, wherein the improvement comprises:

a plurality of cavities in a wall extending between said first and second surfaces, each said cavity communicating with one of said passages and being generally perpendicular to said axis of said passages; and the contact portion of each said female contact member being generally planar and having an opening for receiving a mating male terminal member, said generally planar mating portion of each female contact member being positioned within one of said cavities and oriented generally perpendicular to the axis of said passage with which said cavity is communicating, each said contact member including a body portion located adjacent said contact portion, said contact portion and said body portion forming a pair of spaced apart resilient arms, said body portion being positioned outside of said cavity.

19. The electrical connector of claim 18 wherein said female contact members further include a base portion between said body portion and said mounting portion and said female terminals are configured so that said arms of said body portion twist relative to said base portion upon mating of said female contact members with said male terminals.

* * * * *